United States Patent [19]

Osada

[11] Patent Number: 4,555,589

[45] Date of Patent: Nov. 26, 1985

[54] LEAD WIRE RETAINER

[75] Inventor: Hiroshi Osada, Yokohama, Japan

[73] Assignee: Nifco Inc., Yokohama, Japan

[21] Appl. No.: 674,809

[22] Filed: Nov. 26, 1984

[51] Int. Cl.[4] ..... H01B 17/58

[52] U.S. Cl. ..... 174/156; 174/175

[58] Field of Search ..... 174/28, 99 R, 111, 135, 174/138 R, 146, 153 G, 154, 155, 156, 175; 24/114.5; 138/112, 113, 114; 333/244

[56] References Cited

U.S. PATENT DOCUMENTS 3,188,030 6/1965 Fischer ..... 174/156 X
3,889,909 6/1975 Koscik ..... 174/153 G X

FOREIGN PATENT DOCUMENTS 2320335 11/1974 Fed. Rep. of Germany ..... 174/28
59-32158 9/1984 Japan ..... 174/138 R

*Primary Examiner*—Laramie E. Askin
*Attorney, Agent, or Firm*—J. O'Brien; A. J. Brunett; T. W. Buckman

[57] ABSTRACT

A lead wire retainer comprises a pair of half rings, retaining means for holding a given lead wire in place, and elastic supporting means for elastically supporting the retaining means. The lead wire retainer is constructed so that the pair of retaining means firmly hold the lead wire when the pair of half rings are joined with the engaging means to complete a full ring.

4 Claims, 8 Drawing Figures

FIG. 1
(PRIOR ART)
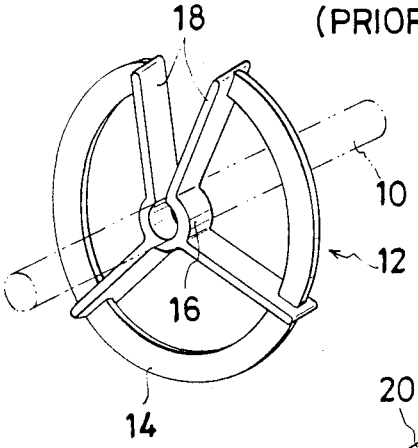
FIG. 2
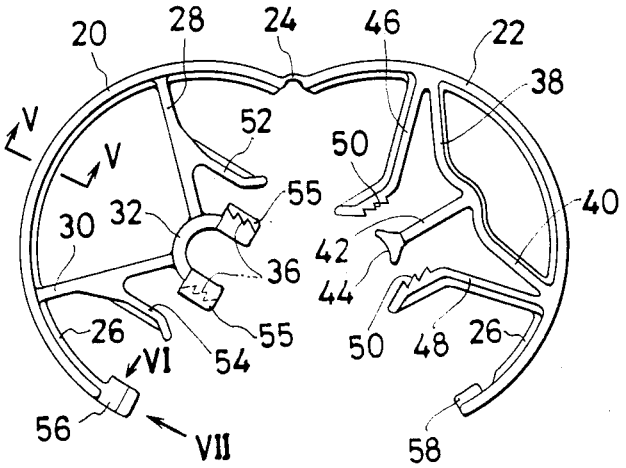
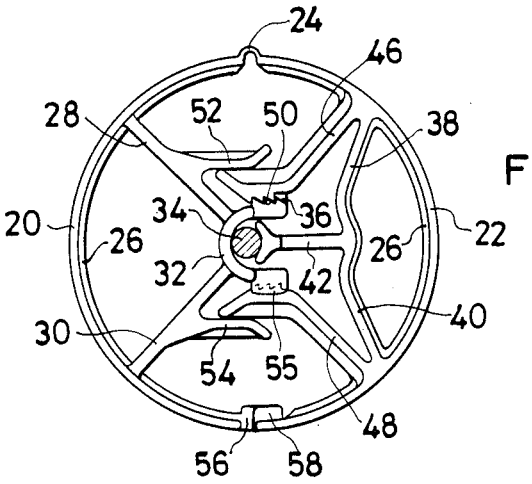
FIG. 4

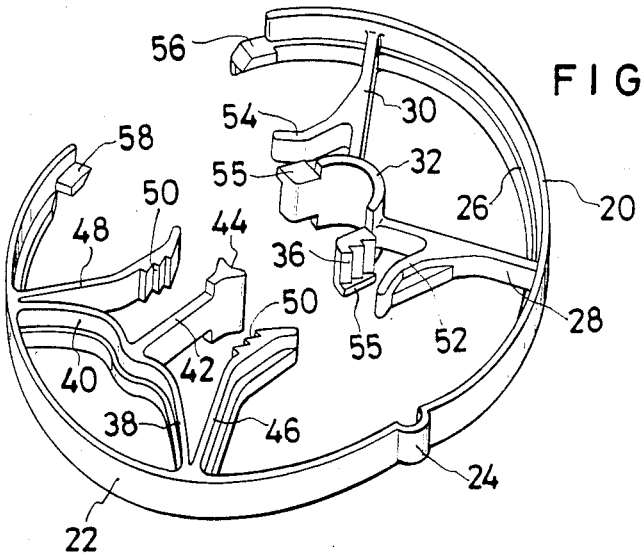
FIG. 3
FIG. 5
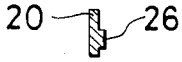
FIG. 6
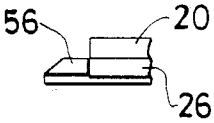
FIG. 7
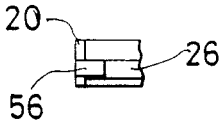
FIG. 8
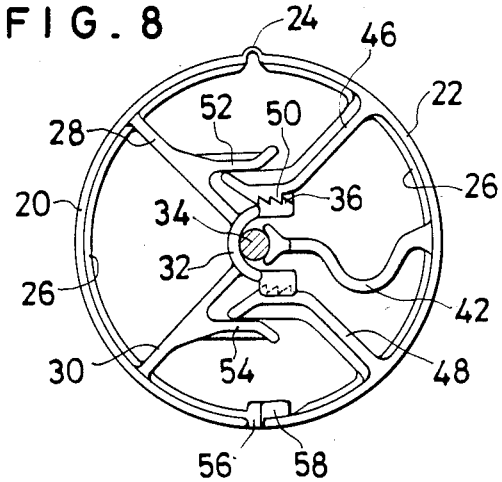

LEAD WIRE RETAINER

BACKGROUND OF THE INVENTION

1. Field of the Invention

This invention relates to a lead wire retainer for holding a lead wire or other similar object at a fixed distance from another object such as a chassis or an enclosure.

2. Description of Prior Art

A conventional retainer 12 for holding a lead wire 10 fast in place, as illustrated in FIG. 1, has an outer ring 14 and a C-shaped retainer part 16 at the center which firmly retains the lead wire 10 inserted along guide plates 18 extending from a notch formed in part of the ring 14 to the C-shaped retainer part 16 (as disclosed in Japanese Patent Application Disclosure SHO 59(1984)-32158, for example).

This retainer 12 is used, for example, in conjunction with a TV picture tube to hold the lead wire 10 at a fixed distance from such objects as the conductive parts on tubes or an associated chassis or enclosure, and prevent the lead wire 10 from shorting.

The conventional retainer 12 constructed as described above, however, is only capable of holding a lead wire of a fixed diameter. When a lead wire of a different diameter is used, the retainer 12 cannot be readily adapted to the new lead wire and fails to hold the lead wire fast in place at the stated distance from the given object.

An object of this invention is to overcome the awkward situation encountered by the conventional retainer by providing a retainer easy to use and capable of holding lead wires and rod-shaped objects of various diameters fast in place.

SUMMARY OF THE INVENTION

The retainer of this invention has a pair of half rings joined to each other with fastening means to complete one full ring. A pair of retaining means adapted to nip a given object when the half rings are joined to each other are projected one each from the inner sides of the half rings. Elastic support means is formed which serves to support one of these retaining means elastically relative to the other retaining means and, consequently, change its own shape in conformity with the outside diameter of the object and ensure fast retention of the object in place.

The other objects and characteristic features of the present invention will become apparent to those skilled in the art as the disclosure is made in the following description of a preferred embodiment of the invention, as illustrated in the accompanying drawings.

BRIEF DESCRIPTION OF THE DRAWINGS

FIG. 1 is a perspective view illustrating a typical lead wire retainer of prior art. FIG. 2 is a front view of a lead wire retainer as one embodiment of this invention, held in an open state.

FIG. 3 is a perspective view illustrating the retainer of FIG. 2, held in an open state.

FIG. 4 is a front view illustrating the retainer of FIG. 2, in a state holding a lead wire in place.

FIG. 5 is a cross section taken along the line V—V in FIG. 2.

FIG. 6 is a fragmentary view taken in the direction of the arrow VI in FIG. 2.

FIG. 7 is a fragmentary view taken in the direction of the arrow VII in FIG. 2.

FIG. 8 is a front view illustrating a lead wire retainer as another embodiment of this invention.

DESCRIPTION OF PREFERRED EMBODIMENTS

FIG. 2 through FIG. 7 illustrate a lead wire retainer as the first embodiment of this invention. This retainer comprises a pair of half rings 20, 22 integrally molded of synthetic resin. These half rings 20, 22 are joined to each other through the medium of an integral hinge 24 which is partly constricted and, therefore, allowed to deform elastically. Owing to the elastic deformation of the integral hinge 24, the half rings 20, 22 can be moved relative to each other from the state illustrated in FIG. 2 and FIG. 3 to the state of fast engagement illustrated in FIG. 4.

The half rings 20, 22 are made of a strip member of a cross section illustrated in FIG. 5. Ribs 26 projected from part of the widths of these strip members serve to reinforce the half rings 20, 22.

In the first half ring 20, a pair of arms 28, 30 are projected radially from two points separated by a prescribed length from each other toward the center of the radius of curvature of the half ring 20. To the leading ends of these arms is connected a semicylinder 32 constituting one half of the retaining means. This semicylinder 32 is adapted to accommodate a lead wire 34 (the object to be retained) as illustrated in FIG. 4. In the opposite ends of the semicylinder 32, sawtooth parts 36 each containing a plurality of tooth faces are formed one each on the outer sides to constitute one half of an engaging means.

In the other half ring 22, a pair of branch arms 38, 40 are projected from two points separated by a prescribed length in directions approaching each other and eventually join each other. From the point of the joint of the branch arms 38, 40, an arm 42 is projected toward the center of the radius of curvature of the half ring 22. The leading end of this arm 42 forms an arcuate part 44 which is opposed to the semicylinder 32. This arcuate part 44 constitutes the other half of the aforementioned retaining means and fulfills the role of pressing the lead wire 34 against the semicylinder 32 when the half rings 20, 22 are joined to form a full ring as illustrated in FIG. 4. During the closing of the half rings 20, 22, the branch arms 38, 40 are elastically deformed so as to be utilized as elastic retaining means for pressing the lead wire 34 against the semicylinder 32.

Approximately from the portions of the half ring 22 at which the branch arms 38, 40 join the half ring, engaging arms 46, 48 are projected toward the center of the radius of curvature of the half ring 22. The leading ends of the engaging arms 46, 48 are disposed in parallel to each other and are provided on their mutually opposed inner sides with engaging sawtooth parts 50 to constitute the other half of the aforementioned engaging means. When the half rings 20, 22 are joined to each other to complete a full ring, the sawtooth parts 50 come into fast engagement with the engaging sawtooth parts 36 so as to keep the full ring intact.

For the engaging sawtooth parts 50 to be retained fast in engagement with the engaging sawtooth parts 36, pressure arms 52, 54 are projected from the portions of the arms 28, 30 falling halfway along the length thereof and allowed to collide against the engaging arms 46, 48 on the sides opposite those containing the sawtooth parts. As a result, the engaging sawtooth parts 50 are restrained from moving away from the engaging sawtooth parts 36.

Further, the engaging sawtooth parts 36 on the semicylinder 32 are provided at the ends thereof in the direction of width (in the direction perpendicular to the surface of the sheet containing FIG. 2 and FIG. 4) each with a stopper plate 55, so that the engaging sawtooth parts 36, 50 will not accidentally move relative to each other in the direction of width and come off each other.

The ends of the half rings 20, 22 opposite the integral hinge 24 are adapted so as to be superposed one over the other as illustrated in FIG. 4 when the half rings complete one full ring. As a result, the lead wire 34 is kept fast in its isolated state while the full ring retains its complete form. The half rings 20, 22 are provided at the leading ends thereof with flat plates 56, 58 to ensure correct superposition of the leading ends.

With the retainer of the present embodiment constructed as described above, desired attachment of the lead wire 34 is accomplished by opening the half rings 20, 22 to the state illustrated in FIG. 2, inserting the lead wire 34 inside the semicylinder 32, and joining the half rings 20, 22 in the shape of a full ring as illustrated in FIG. 4.

Consequently, the engaging sawtooth parts 50 come into fast engagement with the engaging sawtooth parts 36 and the leading ends of the half rings 20, 22 are mutually superposed, to complete the full ring.

The branch arms 38, 40 acquire from their elastic deformation the elastic force for keeping the lead wire 34 nipped between the semicylinder 32 and the arcuate part 44. Thus, any of various lead wires 34 having considerably different diameters can be retained fast in place.

Even when the outside diameters of different lead wires 34 vary largely, this variation can be coped with by suitably changing the position of engagement between the engaging sawtooth parts 50 and the engaging sawtooth parts 36 which each have a plurality of tooth faces formed therein. As a result, the lead wire 34 can be nipped fast between the semicylinder 32 and the arcuate part 44 and kept away from other external objects.

In the present embodiment, as means for elastically supporting the lead wire 34 between the semicylinder 32 and the arcuate part 44, the force arising from the elastic deformation of the branch arms 38, 40 is chiefly utilized. This invention has no reason to limit the source for the supporting force to such elastic deformation of the branch arms 38, 40. Alternatively, the arm 42 may be constructed so as to be held in place with a cantilever arm containing an elastically deforming part midway of the length thereof as illustrated in FIG. 8. Nor is there any reason for the means for providing such elastic support to be exclusively disposed on the arm 42 side. It may be formed on the semicylinder 32 side instead.

Optionally, the half rings 20, 22 may be constructed so that deformation produced therein is utilized for elastic support. In the foregoing embodiment, the half rings 20, 22 have been depicted as joined to each other through the integral hinge 24 so as to be deformed elastically. Optionally, these half rings 20, 22 may be formed separately of each other and, when the lead wire 34 is nipped in the state described above, these separate half rings may be joined in the shape of a full ring with the aid of a suitable engaging means. Further, for the engaging means so used to join the half rings and complete the full ring, complementary engaging means (not shown) may be formed one each at the free ends of the half rings.

As described above, the retainer of this invention allows one of the pair of supporting means for nipping the lead wire to be elastically supported in place relative to the other supporting means and, therefore, brings about an excellent effect of holding the lead wire fast in place so long as the outside diameter of the lead wire is within a considerably broad range.

What is claimed is:

1. A lead wire retainer, comprising a pair of half rings, means for joining said half rings to complete a full ring, means for retaining a lead wire within said full ring projecting from said half rings which automatically nip the lead wire when said half rings are brought into mutual engagement, and elastic supporting means for elastically supporting said means for retaining.

2. A lead wire retainer according to claim 1, further comprising an integral hinge joining said pair of half rings at one end.

3. A lead wire retainer according to claim 1, wherein said retaining means is comprised of a member formed in one of said half rings which possesses a depression for accommodating said lead wire and a member formed in the other half ring which serves to press said lead wire against said depression.

4. A lead wire retainer, comprising a pair of half rings, engaging means for joining said pair of half rings at one end, integral hinge means joining said pair of half rings at the opposite end, a pair of retaining means projecting one each from said half rings and adapted to nip a given lead wire therebetween when said half rings are brought into mutual engagement, said pair of retaining means comprising a member formed in one of said half rings and possessing a depression for accommodating said lead wire and a member formed in the other half ring and serving to press said lead wire against said depression, elastic supporting means for elastically supporting one of said retaining means relative to the other retaining means, said elastic supporting means (comprises) comprising an arm member having one end thereof connected to one of said member possessing said depression and said member serving to press said lead wire against said depression and the other end thereof having forked out parts connected to the inner side of one of said half rings, and the elastic deformation produced by said forked out parts is utilized for elastically supporting said member to which said arm member is connected.

* * * * *